US008805257B2

(12) United States Patent
Ogawahara et al.

(10) Patent No.: US 8,805,257 B2
(45) Date of Patent: Aug. 12, 2014

(54) APPLYING DEVICE, FIXING DEVICE, AND IMAGE FORMING APPARATUS

(75) Inventors: Norio Ogawahara, Kanagawa (JP); Yasushi Nagata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 85 days.

(21) Appl. No.: 13/415,571

(22) Filed: Mar. 8, 2012

(65) Prior Publication Data

US 2013/0011172 A1 Jan. 10, 2013

(30) Foreign Application Priority Data

Jul. 7, 2011 (JP) ..... 2011-151091

(51) Int. Cl.
*G03G 15/20* (2006.01)

(52) U.S. Cl.
USPC ..... 399/327; 399/324; 399/325; 399/346

(58) Field of Classification Search
USPC ..... 399/325, 327
See application file for complete search history.

(56) References Cited

U.S. PATENT DOCUMENTS 5,678,134 A * 10/1997 Miki et al. ..... 399/71
5,978,640 A * 11/1999 Segawa ..... 399/327
5,991,562 A * 11/1999 Ito et al. ..... 399/67
6,026,271 A * 2/2000 Saitoh ..... 399/308
6,060,205 A * 5/2000 Takeichi et al. ..... 430/126.2
6,801,744 B2 10/2004 Fujiwara et al.
7,587,161 B2 * 9/2009 Yamada et al. ..... 399/327
7,756,458 B2 * 7/2010 Viney et al. ..... 399/327
2002/0044805 A1 * 4/2002 Hasegawa ..... 399/325
2002/0154925 A1 * 10/2002 Oota ..... 399/327
2004/0052557 A1 * 3/2004 Fukuta et al. ..... 399/345
2010/0310288 A1 * 12/2010 Takagi et al. ..... 399/327

FOREIGN PATENT DOCUMENTS

JP 2000026614 A * 1/2000
JP 2003-167468 A 6/2003
JP 4407708 B2 2/2010

OTHER PUBLICATIONS

Machine Translation to JP 2000026614A.*

* cited by examiner

*Primary Examiner* — David Gray
*Assistant Examiner* — Francis Gray
(74) *Attorney, Agent, or Firm* — Sughrue Mion, PLLC

(57) ABSTRACT

An applying device includes an applying member that applies an applying material to an outer peripheral surface of a fixing member that rotates, while a peripheral velocity difference is caused to exist between a peripheral velocity of the fixing member and a peripheral velocity of the applying member. The applying material contains a fluorocarbon resin material.

6 Claims, 12 Drawing Sheets

APPLYING DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2011-151091 filed Jul. 7, 2011.

BACKGROUND

(i) Technical Field

The present invention relates to an applying device, a fixing device, and an image forming apparatus.

SUMMARY

According to an aspect of the invention, there is provided an applying device including an applying member that applies an applying material to an outer peripheral surface of a fixing member that rotates, while a peripheral velocity difference is caused to exist between a peripheral velocity of the fixing member and a peripheral velocity of the applying member. The applying material contains a fluorocarbon resin material.

BRIEF DESCRIPTION OF THE DRAWINGS

Exemplary embodiments of the present invention will be described in detail based on the following figures, wherein.

DETAILED DESCRIPTION

An exemplary applying device, an exemplary fixing device, and an exemplary image forming apparatus according to a first exemplary embodiment of the present invention will be described.

Figure 1:
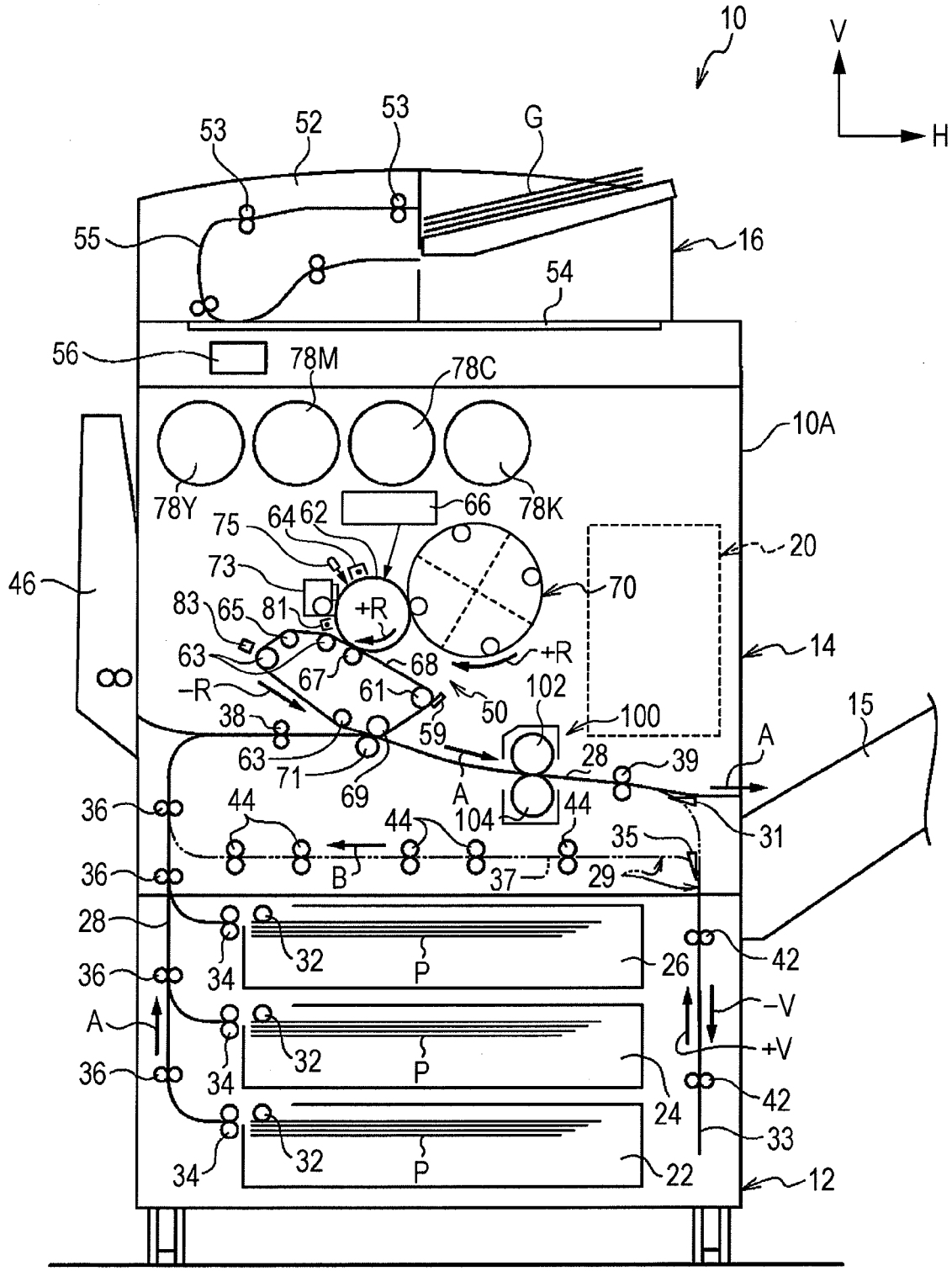
FIG. 1 illustrates an overall structure of an image forming apparatus according to a first exemplary embodiment of the present invention.

FIG. 1 illustrates an exemplary image forming apparatus 10 according to the first exemplary embodiment. The image forming apparatus 10 includes a sheet holding section 12, an image forming section 14, a document reading section 16, and a controller 20 in a vertical direction (the direction of arrow V) from a lower side to an upper side. The sheet holding section 12 holds pieces of recording paper P. The image forming section 14 is provided above the sheet holding section 12, and forms an image on a piece of recording paper P serving as an exemplary recording medium that is supplied from the sheet holding section 12. The document reading section 16 is provided above the image forming section 14, and reads a reading document G. The controller 20 is provided in the image forming section 14, and controls the operation of each portion of the image forming apparatus 10. In the description below, the vertical direction of an apparatus body 10A of the image forming apparatus 10 corresponds to the direction of arrow V, and a horizontal direction thereof corresponds to the direction of arrow H.

The sheet holding section 12 includes a first holding section 22, a second holding section 24, and a third holding section 26, which hold pieces of recording paper P having different sizes. Delivery rollers 32 that deliver the held pieces of recording paper P into a transport path 28 provided in the image forming apparatus 10 are provided at the first holding section 22, the second holding section 24, and the third holding section 26. Pairs of transport rollers 34 and pairs of transport rollers 36 that transport the pieces of recording paper P one at a time are provided downstream from the delivery rollers 32 in the transport path 28. Aligning rollers 38 that temporarily stop the pieces of recording paper P and that deliver the pieces of recording paper P to a second transfer position QB (described later; see FIG. 2) at a set timing are provided downstream from the transport rollers 36 in a direction of transport of the pieces of recording paper P in the transport path 28.

As viewed from the front of the image forming apparatus 10, an upstream-side portion (that is, a portion where the transport rollers 36 are provided) of the transport path 28 is linearly provided from the left side of the sheet holding section 12 to a lower portion of the left side of the image forming section 14 in the direction of arrow V. A downstream-side portion of the transport path 28 is provided from the lower portion of the left side of the image forming section 14 up to a sheet-discharge section 15 provided on the right side of the image forming section 14. A two-side transport path 29 that transports and reverses a piece of recording paper P for forming images on both sides of the piece of recording paper P is connected to the transport path 28.

As seen from the front of the image forming apparatus 10, the two-side transport path 29 is provided with a first switching member 31, a reversing section 33, a transport section 37, and a second switching member 35. The first switching member 31 switches between the transport path 28 and the two-side transport path 29. The reversing section 33 is linearly provided from a lower portion of the right side of the image forming section 14 to the right side of the sheet holding section 12 in the direction of arrow V (a downward direction is indicated by −V and an upward direction is indicated by +V in the FIG. 1). A rear edge of a piece of recording paper P transported to the reversing section 33 enters the transport section 37, and the piece of recording paper P is transported to the left in FIG. 1 on the basis of the direction of arrow H. The second switching member 35 switches between the reversing section 33 and the transport section 37. Pairs of transport rollers 42 are provided at the reversing section 33 so as to be spaced apart from each other. Pairs of transport rollers 44 are provided at the transport section 37 so as to be spaced apart from each other.

The first switching member 31 is a triangular columnar member. When an end portion of the first switching member 31 is moved to either one of the transport path 28 and the two-side transport path 29 by a driving unit (not shown), the first switching member 31 switches the direction of transport of the recording paper P. The second switching member 35 is similarly a triangular columnar member when viewed from the front side. When an end portion of the second switching member 35 is moved to either one of the reversing section 33 and the transport section 37 by a driving unit (not shown), the second switching member 35 switches the direction of transport of the recording paper P. A downstream-side end portion of the transport section 37 is connected to a near side of the transport rollers 36, disposed at the upstream-side portion of the transport path 28, by a guide member (now shown). A folding manual paper feed section 46 is provided at a left surface of the image forming section 14. A transport path of a piece of recording paper P that is transported from the manual paper feed section 46 is connected to a near side (upstream side) of the aligning rollers 38 at the transport path 28.

The document reading section 16 includes a document transport device 52, a platen glass 54, and a document reading device 56. The document transport device 52 automatically transports reading documents G one at a time. The platen glass 54 is disposed at a lower side of the document transport device 52. One reading document G is placed on the platen glass 54. The document reading device 56 reads a reading document G transported by the document transport device 52, or a reading document G placed on the platen glass 54.

The document transport device 52 includes an automatic transport path 55 in which pairs of transport rollers 53 are disposed. A portion of the automatic transport path 55 is disposed so that a piece of recording paper P passes above the platen glass 54. The document reading device 56 reads a reading document G transported by the document transport device 52 while being stationary at a left end portion of the platen glass 54, and reads a reading document G placed on the platen glass 54 while moving in the direction of arrow H.

The image forming section 14 includes an image forming unit 50 serving as an exemplary developer image forming unit that forms a toner image (developer image) on a piece of recording paper P. The image forming unit 50 includes a photoconductor member 62, a charging member 64, an exposure device 66, a developing device 70, an intermediate transfer belt 68, and a cleaning device 73, which are described below.

The cylindrical photoconductor member 62 serving as a latent image holding member is provided at the center of the apparatus body 10A in the image forming section 14. The photoconductor member 62 is rotated in the direction of arrow +R (counterclockwise in FIG. 1) by a driving unit (not shown), and holds an electrostatic latent image formed by light irradiation. The corotron charging member 64 that charges the surface of the photoconductor member 62 is provided at a location that is situated above the photoconductor member 62 and that opposes an outer peripheral surface of the photoconductor member 62.

The exposure device 66 is provided at a location that is situated downstream from the charging member 64 in a direction of rotation of the photoconductor member 62 and that opposes the outer peripheral surface of the photoconductor member 62. The exposure device 66 includes a semiconductor laser, a f-θ lens, a polygonal mirror, an imaging lens, and mirrors (none of which are shown). On the basis of an image signal, laser light emitted from the semiconductor laser is used to perform scanning by being deflected by the polygonal mirror, and illuminates (exposes) the outer peripheral surface of the photoconductor member 62 charged by the charging member 64, to form an electrostatic latent image. The exposure device 66 may be a light emitting diode (LED) type instead of a type in which laser light is used to perform scanning by being deflected by the polygonal mirror.

The developing device 70 of a rotation switching type is provided at a location opposing a portion that is situated downstream from a portion of the photoconductor member 62 that is irradiated with exposure light from the exposure device 66 in the direction of rotation of the photoconductor member 62. The developing device 70 develops the electrostatic latent image formed on the outer peripheral surface of the photoconductor member 62 with toner of a set color to make the electrostatic latent image visible.

Figure 2:
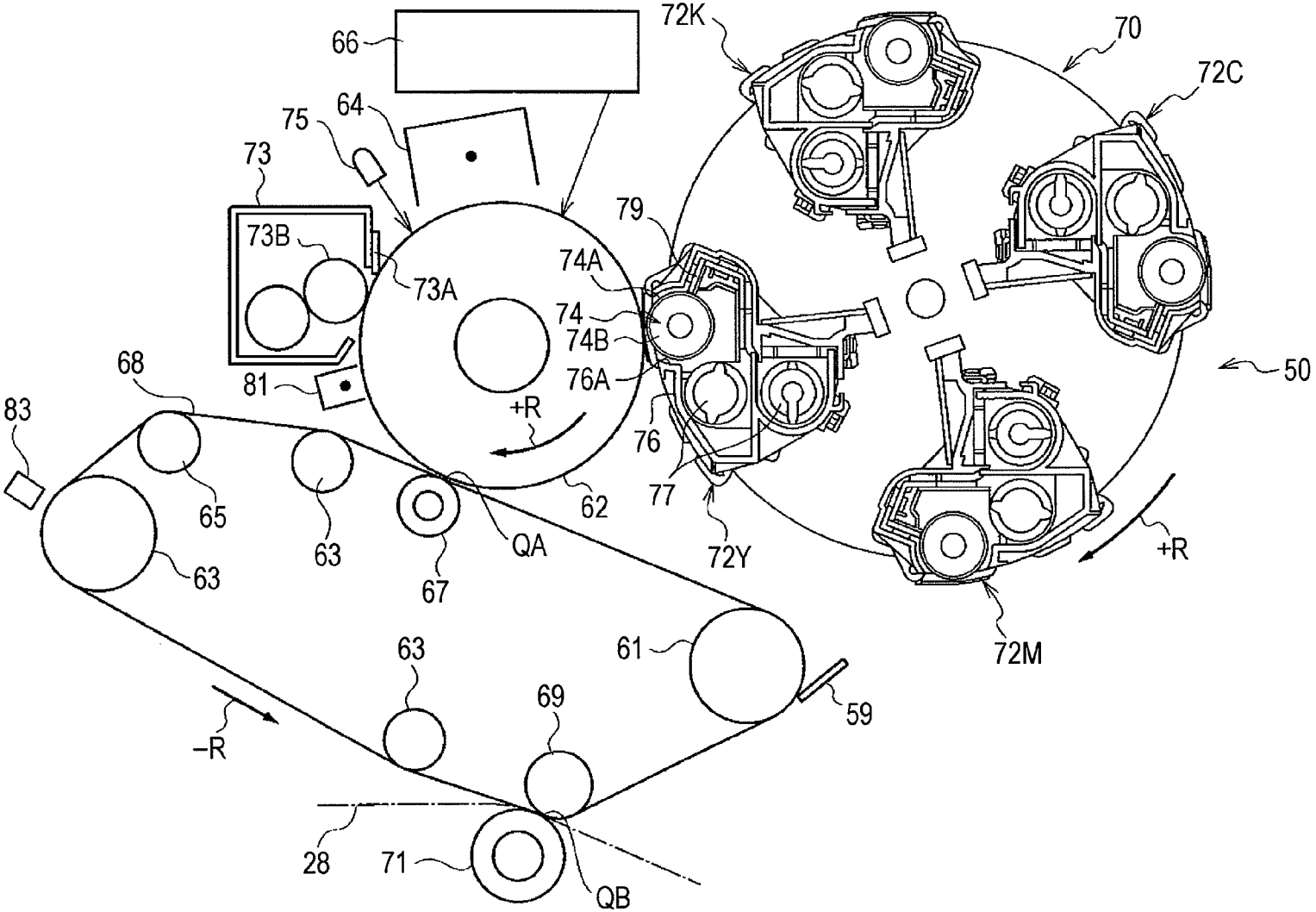
FIG. 2 illustrates a structure of an image forming unit according to the first exemplary embodiment of the present invention.

As shown in FIG. 2, in the developing device 70, exemplary developing units 72Y, 72M, 72C, and 72K corresponding to toner colors, yellow (Y), magenta (M), cyan (C), and black (K), are disposed side by side in a peripheral direction (that is, in this order in a counterclockwise direction in FIG. 2). By rotating the developing units by central angles of 90 degrees at a time by a motor (not shown), the developing unit 72Y, 72M, 72C, or 72K is switched to that which performs a developing operation, and the switched developing unit opposes the outer peripheral surface of the photoconductor member 62.

Since the developing units 72Y, 72M, 72C, and 72K, have the same structure, the developing unit 72Y will be described here, and the other developing units 72M, 72C, and 72K will not be described.

The developing unit 72Y includes a case member 76 serving as a body. The interior of the case member 76 is filled with a developer (not shown) containing toner and carriers supplied from a toner cartridge 78Y (see FIG. 1) through a toner supply path (not shown). A rectangular opening 76A that opposes the outer peripheral surface of the photoconductor member 62 is formed in the case member 76. A development roller 74 whose outer peripheral surface opposes the outer peripheral surface of the photoconductor member 62 is provided at the opening 76A. A plate-like regulating member 79 that regulates the thickness of a layer of a developer is provided near the opening 76A in the case member 76 along a longitudinal direction of the opening 76A.

The development roller 74 includes a rotatable cylindrical development sleeve 74A and a magnetic member 74B including magnetic poles and secured to the inner side of the development sleeve 74A. By rotating the development sleeve 74A, a magnetic brush of a developer (carrier) is formed. In addition, by regulating the thickness of the layer of the developer by the regulating member 79, the developer layer is formed on an outer peripheral surface of the development sleeve 74A. The developer layer on the outer peripheral surface of the development sleeve 74A is transported to a location opposing the photoconductor member 62 by rotating the development sleeve 74A, so that toner corresponding to the latent image (electrostatic latent image) formed on the outer peripheral surface of the photoconductor member 62 is caused to adhere to the latent image, thereby developing the latent image.

Two rotatable spiral transport rollers 77 are disposed side by side in the case member 76. By rotating the two transport rollers 77, the developer with which the interior of the case member 76 is filled is circulated and transported in an axial direction of the development roller 74 (that is, in a longitudinal direction of the developing unit 72Y). Four development rollers 74 provided at the corresponding developing units 72Y, 72M, 72C, and 72K are disposed in the peripheral direction so that development rollers 74 that are adjacent to each other are spaced apart by a central angle of 90 degrees. By switching a certain developing unit 72, a next development roller 74 is caused to oppose the outer peripheral surface of the photoconductor member 62.

As shown in FIG. 2, the intermediate transfer belt 68 to which a toner image formed on the outer peripheral surface of the photoconductor member 62 is transferred is provided downstream from the developing device 70 in the direction of rotation of the photoconductor member 62 and below the photoconductor member 62. The intermediate transfer belt 68 is an endless belt, and is wound on a driving roller 61, a tension applying roller 65, transport rollers 63, and an auxiliary roller 69. The driving roller 61 is rotationally driven by the controller 20 (see FIG. 1). The tension applying roller 65 applies tension to the intermediate transfer belt 68. The transport rollers 63 contact an inner side of the intermediate transfer belt 68, and are driven and rotated. The auxiliary roller 69 contacts the inner side of the intermediate transfer belt 68 and is driven and rotated at the second transfer position QB (described later). When the driving roller 61 rotates, the intermediate transfer belt 68 rotates in the direction of arrow –R (that is, counterclockwise in FIG. 1).

A first transfer roller 67 that first-transfers a toner image formed on the outer peripheral surface of the photoconductor member 62 to the intermediate transfer belt 68 is provided opposite the photoconductor member 62 with the intermediate transfer belt 68 being interposed therebetween. The first transfer roller 67 contacts the inner surface of the intermediate transfer belt 68 at a location that is spaced apart and downstream in the direction of movement of the intermediate transfer belt 68 from a position where the photoconductor member 62 and the intermediate transfer belt 68 contact each other (this position is called a first transfer position QA (see FIG. 2)). By applying current from a power supply (not shown), the first transfer roller 67 first-transfers the toner image on the photoconductor member 62 to the intermediate transfer belt 68 due to a potential difference between the first transfer roller 67 and the photoconductor member 62 connected to ground.

A second transfer roller 71 serving as an exemplary transfer unit that second-transfers the toner image first-transferred to the intermediate transfer belt 68 to a piece of recording paper P is provided opposite the auxiliary roller 69 with the intermediate transfer belt 68 being interposed therebetween. A position between the second transfer roller 71 and the auxiliary roller 69 is the second transfer position QB where the toner image is transferred to the piece of recording paper P. The second transfer roller 71 is connected to ground and contacts an outer surface of the intermediate transfer belt 68. Due to a potential difference between the second transfer roller 71 and the auxiliary roller 69 to which current is applied from a power supply (not shown), the second transfer roller 71 causes the toner image on the intermediate transfer belt 68 to be second-transferred to the piece of recording paper P. The second transfer position QB is set in the transport path 28 (see FIG. 1).

A cleaning blade 59 that collects residual toner remaining after the second transfer on the intermediate transfer belt 68 is provided opposite the driving roller 61 with the intermediate transfer belt 68 being interposed therebetween. The cleaning blade 59 is mounted to a housing (not shown) having an opening. The toner scraped off by an end portion of the cleaning blade 59 is collected in the housing.

A position detecting sensor 83 is provided at a position opposing one of the transport rollers 63 in the vicinity of the intermediate transfer belt 68. The position detecting sensor 83 detects a mark (not shown) on the surface of the intermediate transfer belt 68 to detect a predetermined reference position on the intermediate transfer belt 68, and outputs a position detection signal serving as a reference of a timing of starting an image forming operation. The position detecting sensor 83 illuminates the intermediate transfer belt 68 with light, and receives the light reflected from the surface of the mark, to detect the position of movement of the intermediate transfer belt 68.

A cleaning device 73 that cleans off, for example, residual toner remaining on the surface of the photoconductor member 62 without being first-transferred to the intermediate transfer belt 68 is provided downstream from the first transfer roller 67 in the direction of rotation of the photoconductor member 62. The cleaning device 73 is formed so that, for example, residual toner is collected by a cleaning blade 73A and a brush roller 73B that contact the surface of the photoconductor member 62.

A corotron 81 that removes electricity from the toner remaining after the first transfer on the outer peripheral surface of the photoconductor member 62 is provided upstream from the cleaning device 73 (that is, downstream from the first transfer roller 67) in the direction of rotation of the photoconductor member 62. Further, an electricity removing device 75 that removes electricity by irradiating the outer peripheral surface of the photoconductor member 62 with light after the cleaning is provided downstream from the cleaning device 73 (that is, upstream from the charging member 64) in the direction of rotation of the photoconductor member 62.

As shown in FIG. 1, a fixing device 100 that fixes the toner image to a piece of recording paper P to which the toner image has been transferred by the second transfer roller 71 is provided downstream from the second transfer roller 71 in the direction of transport of the recording paper P. The fixing device 100 will be described in more detail later. Transport rollers 39 that transport the piece of recording paper P towards the discharge section 15 or the reversing section 33 are provided downstream from the fixing device 100 in the direction of transport of the recording paper P.

The toner cartridge 78Y and toner cartridges 78M, 78C, and 78K that contain toners of corresponding colors, yellow (Y), magenta (M), cyan (C), and black (K), are replaceably provided side by side in the direction of arrow H and above the developing device 70 that is situated below the document reading device 56.

Next, the fixing device 100 will be described.

Figure 3:
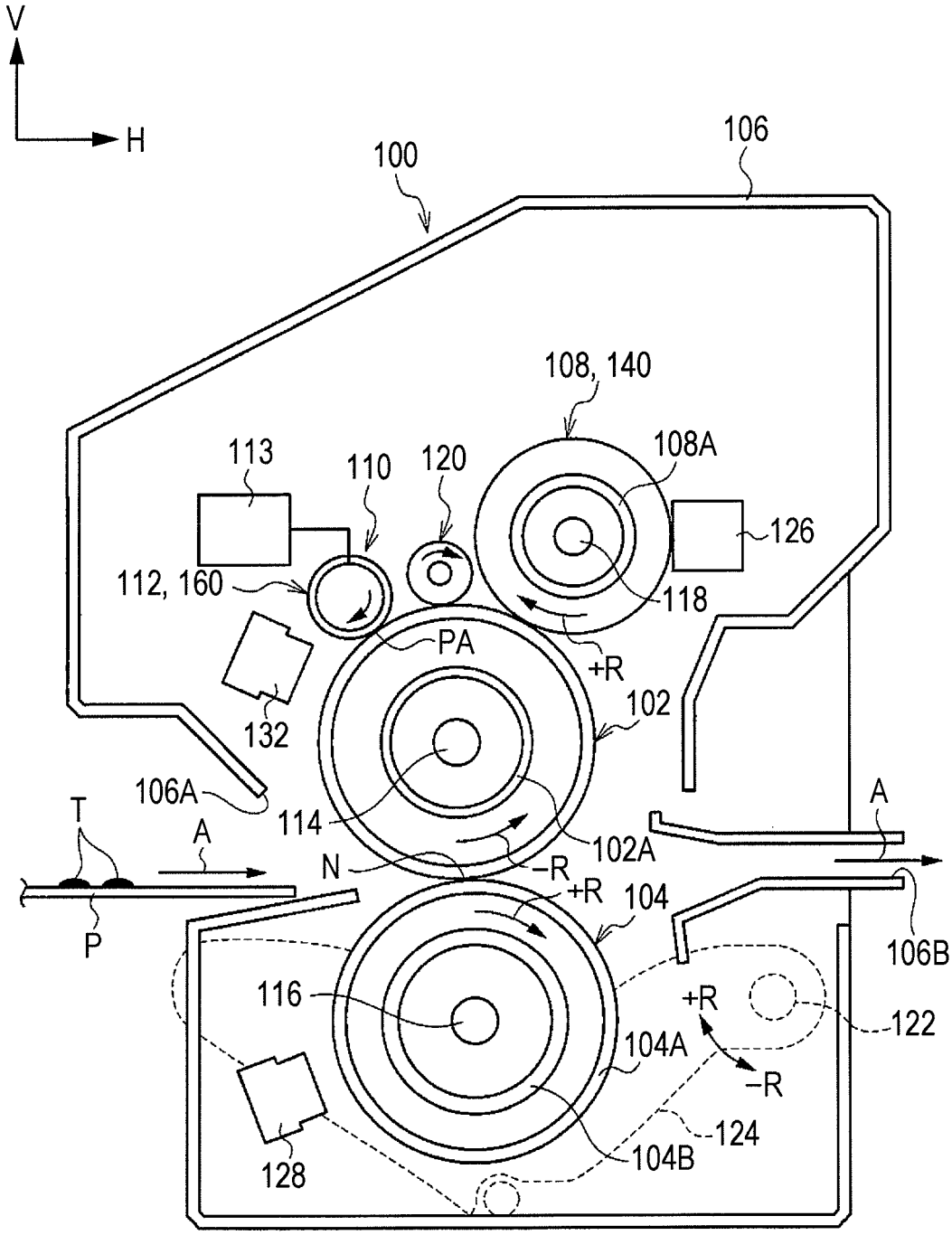
FIG. 3 illustrates a structure of a fixing device according to the first exemplary embodiment of the present invention.

As shown in FIG. 3, the fixing device 100 includes a housing 106 having an opening 106A and an opening 106B. A piece of recording paper P enters the opening 106A. The piece of paper P is discharged from the opening 106B. A fixing roller 102 and a pressure roller 104 are provided as principal portions in the housing 106. The fixing roller 102 serves as an exemplary fixing member that fixes a toner image (developer image) to the recording paper P by heating the toner image. The pressure roller 104 serving as an exemplary pressing member applies pressure with the recording paper P being interposed between the pressure roller 104 and the fixing roller 102.

An external heating roller 108, a retracting mechanical section 140 (see FIG. 4), an applying unit 110, and a cleaning roller 120 are also provided as principle portions in the housing 106. The external heating roller 108 contacts and heats an outer peripheral surface of the fixing roller 102. The retracting mechanical section 140 moves the external heating roller 108 to the outer peripheral surface of the fixing roller 102. The applying unit 110 serves as an applying device that applies an applying material 112B (described later; refer to FIG. 5B) to the outer peripheral surface of the fixing roller 102. The cleaning roller 120 serves as an exemplary cleaning unit and an exemplary rotary member that cleans the outer peripheral surface of the fixing roller 102.

Figure 5A:
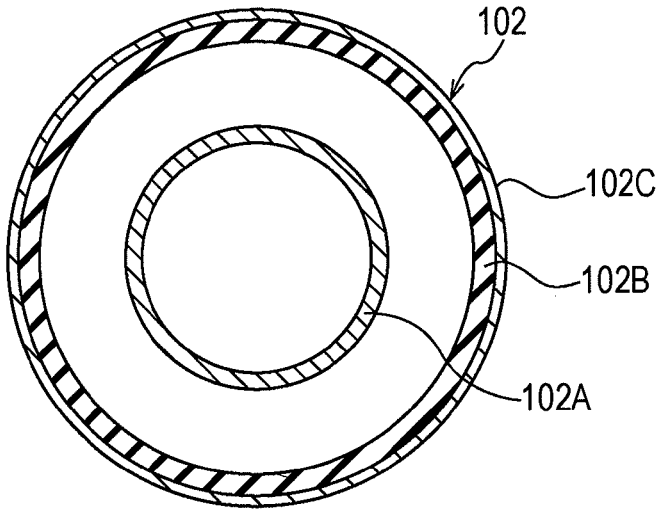
FIG. 5A is a sectional view of a fixing roller according to the first exemplary embodiment of the present invention.
Figure 7:
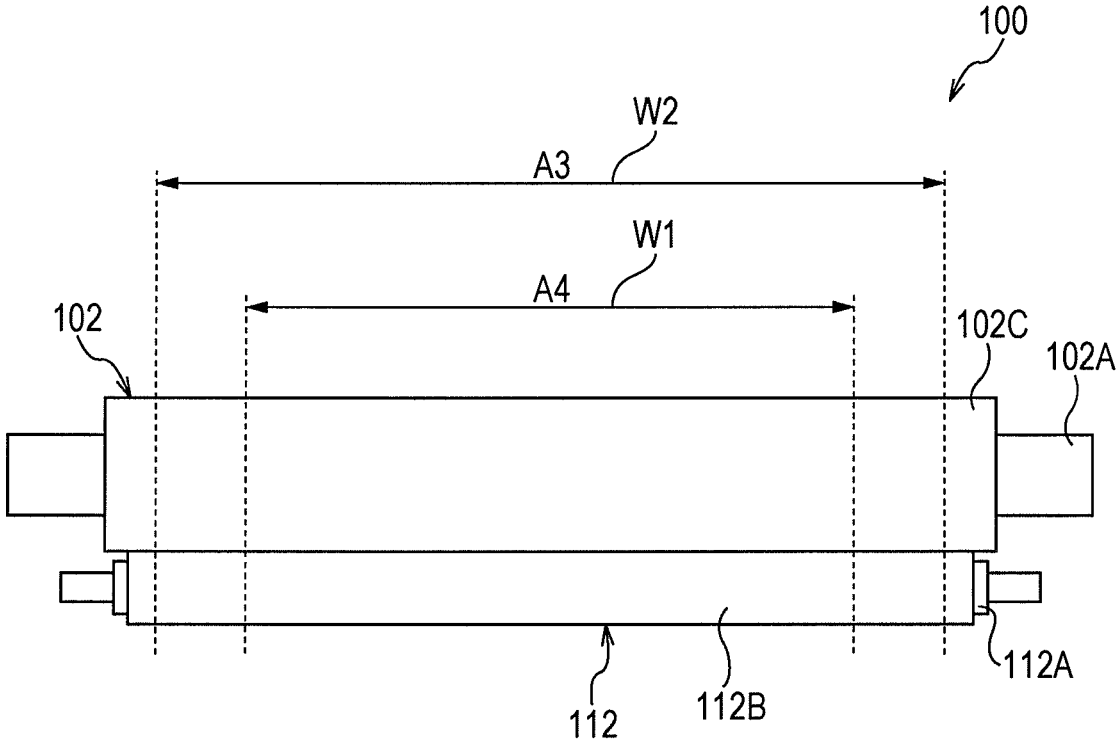
FIG. 7 is a schematic view illustrating a range of passage of recording paper at the fixing roller according to the first exemplary embodiment of the present invention, and the relationship between the dispositions of the fixing roller and the applying roller.

The fixing roller 102 is disposed at a toner image surface side (upper side) of the recording paper P at the transport path. In an example of the fixing roller 102, as shown in FIG. 5A, an outer periphery of an aluminum cylindrical core bar 102A is covered by a silicone rubber 102B, and a surface layer having separability allowing recording paper to separate therefrom 102C formed of polytetrafluoroethylene-perfluoroalkyl vinyl ether copolymer (PFA), which is a fluorocarbon resin, is formed along an outer periphery of the silicone rubber 102B. As shown in FIG. 7, the width of the fixing roller 102 in an axial direction thereof is larger than a width W1 of A4-size recording paper P and a width W2 of A3-size recording paper P. The fixing roller 102 is capable of performing fixing on multiple types of recording paper P having different widths.

As shown in FIG. 3, a halogen heater 114 serving as a heat source is provided inwardly from the core bar 102A so as to be out of contact with an inner peripheral surface of the core bar 102A. The halogen heater 114 generates heat by application of current from a power supply (not shown), and heats the core bar 102A, so that the entire fixing roller 102 is heated.

The external heating roller 108, the cleaning roller 120, an applying roller 112 serving as an exemplary applying member, and a first temperature sensor 132 are provided at positions opposing the outer peripheral surface of the fixing roller 102 in that order from an upstream side towards a downstream side in the direction of rotation of the fixing roller 102. The applying roller 112 applies the applying material 112B (see FIG. 5B) to the outer peripheral surface of the fixing roller 102. The first temperature sensor 132 detects the temperature of the fixing roller 102. The applying roller 112 is included in the applying unit 110. In FIG. 3, for the purpose of explanation, the external heating roller 108, the cleaning roller 120, and the applying roller 112 are all shown as contacting the outer peripheral surface of the fixing roller 102. However, during an actual operation of the fixing device 100, as described below, not all of them contact the outer peripheral surface of the fixing roller 102.

For example, the external heating roller 108 is an aluminum cylindrical roller, and includes a cylindrical shaft section 108A at each end portion in a longitudinal direction thereof. A halogen heater 118 is provided at an inner side of the external heating roller 108. The halogen heater 118 serves as a heat source that is out of contact with an inner peripheral surface of the external heating roller 108. The halogen heater 118 generates heat by application of current of a power supply (not shown), and, for example, heats the external heating roller 108 to a temperature that is higher than the temperature of the fixing roller 102 by approximately 50° C. to 70° C.

The external heating roller 108 is provided so as oppose the outer peripheral surface of the fixing roller 102. The external heating roller 108 is moved by an operation of the retracting mechanical section 140 (described later; see FIG. 4), so that the external heating roller 108 is capable of contacting and retracting from the outer peripheral surface of the fixing roller 102. Further, a contact second temperature sensor 126 and a web (not shown) contact an outer peripheral surface of the external heating roller 108. The second temperature sensor 126 detects the temperature of the external heating roller 108. The web supplies oil to the outer peripheral surface of the external heating roller 108.

Figure 4:
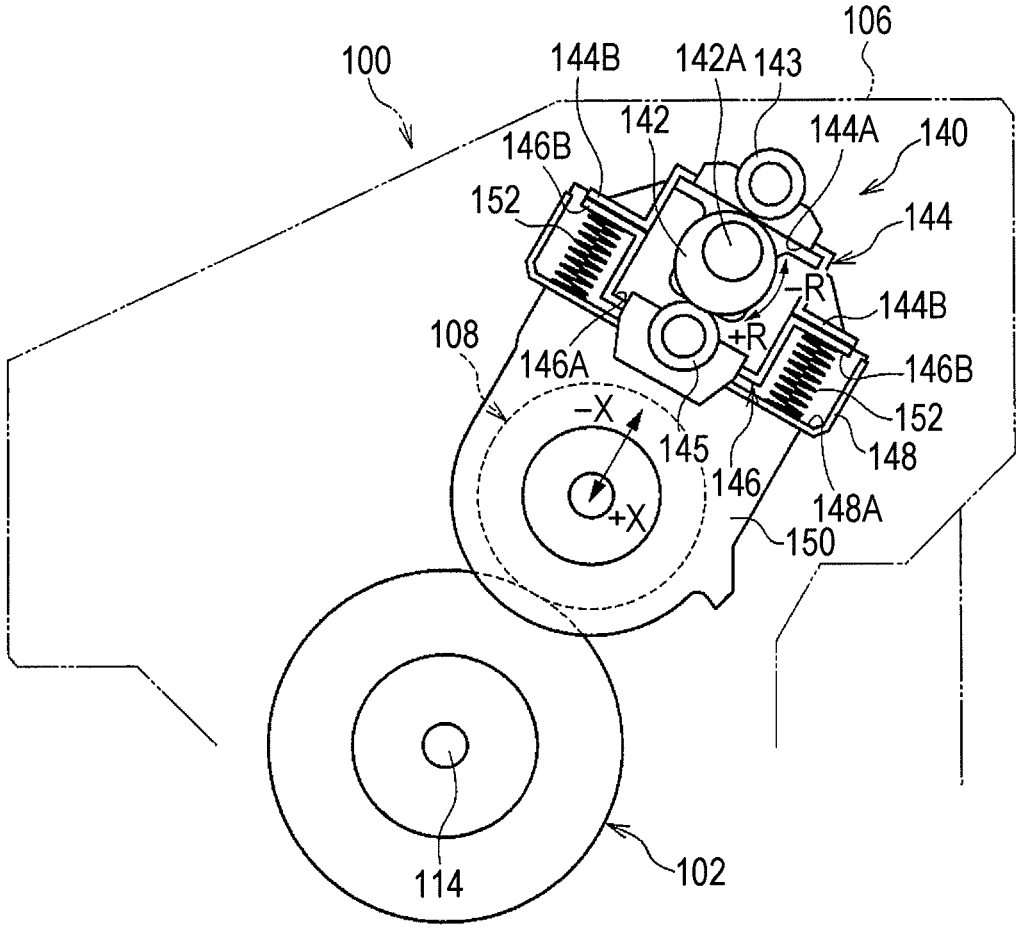
FIG. 4 illustrates a retracting mechanism of an external heating roller according to the first exemplary embodiment of the present invention.

As shown in FIG. 4, the retracting mechanical section 140 includes an eccentric cam 142, an upper bracket 144 and a lower bracket 146, a supporting bracket 150, and springs 152. The upper bracket 144 and the lower bracket 146 oppose each other with the eccentric cam 142 being interposed therebetween. The supporting bracket 150 includes a flange 148 opposing the lower bracket 146, and supports both ends of the external heating roller 108 in an axial direction thereof. One end of each spring 152 is mounted to the lower bracket 146, and the other end of each spring 152 is mounted to the flange 148. The direction which the external heating roller 108 moves closer to the fixing roller 102 is defined as a +X direction, and the direction in which the external heating roller 108 moves away from the fixing roller 102 is defined as a −X direction. The +X direction and the −X direction are defined on the basis of a line that is inclined rightwards in FIG. 4.

The eccentric cam 142 has a rotary shaft 142A whose axial direction is the same as the axial direction of the external heating roller 108. The eccentric cam 142 is rotationally driven in the direction of arrow +R or in the direction of arrow −R by a motor (not shown) that is driven by the controller 20 (see FIG. 1). The eccentric cam 142 may be rotated by continuous driving that causes the eccentric cam 142 to be continuously rotated in one direction or by switching driving that causes the eccentric cam 142 to be rotated in one direction and then to be reversely driven in another direction.

The bracket 144 has a recessed portion 144A at a center thereof as viewed in the axial direction of the external heating roller 108. A flat portion 144B is formed outwardly from a peripheral edge of the recessed portion 144A (that is, outwardly in a direction crossing the direction of arrow X). The upper bracket 144 is disposed in the −X direction from the eccentric cam 142. An open side of the recessed portion 144A is disposed so as to oppose the eccentric cam 142. An upper follower 143 is provided at the upper bracket 144. The upper follower 143 is rotatably provided at the recessed portion 144A and rotates by contacting an outer peripheral surface of the eccentric cam 142.

The lower bracket 146 has a recessed portion 146A at a center thereof as viewed in the axial direction of the external heating roller 108. A flat portion 146B is formed outwardly from a peripheral edge of the recessed portion 146A (that is, outwardly in a direction crossing the direction of arrow X). The lower bracket 146 is disposed in the +X direction from the eccentric cam 142. An open side of the recessed portion 146A is disposed so as to oppose the eccentric cam 142. A lower follower 145 is provided at the lower bracket 146. The lower follower 145 is rotatably provided at the recessed portion 146A and rotates by contacting the outer peripheral surface of the eccentric cam 142.

Here, the upper bracket 144 and the lower bracket 146 are fastened to each other with bolts and nuts (not shown) with the flat portion 144B and the flat portion 146B being in contact with each other so that the recessed portion 144A and the recessed portion 146A are disposed on both sides of the eccentric cam 142. A center of rotation of the eccentric cam 142, a center of rotation of the upper follower 143, and a center of rotation of the lower follower 145 are disposed on a same line in the direction of arrow X. The directions of movements of the upper bracket 144 and the lower bracket 146 are restricted to only the +X direction and the −X direction by a guide member (not shown).

A bearing (not shown) is mounted to the supporting bracket 150. The bearing rotatably supports the external heating roller 108. Although a pair of supporting brackets 150 are provided, one at each end of the external heating roller 108, only one of the supporting brackets 150 will be shown here. The movement of the supporting bracket 150 is restricted to only the +X direction and the −X direction by a guide member (not shown).

Further, the flange 148 of the bracket 150 protrudes from the supporting bracket 150 in the axial direction of the external heating roller 108. The flange 148 is disposed so that its open side faces the lower bracket 146. With the directions of arrow X being defined as the directions of expansion and contraction of the springs 152, one end of each spring 152 is secured to the flat portion 146B of the lower bracket 146, and the other end of each spring 152 is secured to the flat portion 148A of the flange 148.

Here, in the retracting mechanical section 140, when the eccentric cam 142 and the lower follower 145 contact each other, and the upper bracket 144 and the lower bracket 146 move in the +X direction, the springs 152 bias the flange 148 in the +X direction. This causes the supporting bracket 150 to move in the +X direction, so that the external heating roller 108 contacts the outer peripheral surface of the fixing roller 102 (hereunder referred to as a contacting operation of the retracting mechanical section 140).

In contrast, when the eccentric cam 142 and the upper follower 143 contact each other, and the upper bracket 144 and the lower bracket 146 move in the −X direction, a force acts in a direction in which each spring 152 contracts, so that the flange 148 is pulled in the −X direction. This causes the supporting bracket 150 to move in the −X direction, so that the external heating roller 108 separates from the outer peripheral surface of the fixing roller 102 (hereunder referred to as a retracting operation of the retracting mechanical section 140). In this way, the retracting mechanical section 140 switches between a state in which the external heating roller 108 contacts the fixing roller 102 and a state in which the external heating roller 108 does not contact the fixing roller 102.

As shown in FIG. 3, in the direction of rotation of the fixing roller 102, the cleaning roller 120 is rotatably provided upstream from an application position PA where the applying material 112B (see FIG. 5B) is applied by the applying roller 112. As shown in FIG. 5C, the cleaning roller 120 includes an elastic member 120B formed of silicone rubber provided at (covering) an outer peripheral surface of a columnar core bar 120A formed of stainless steel (SUS). As shown in FIG. 6A, the cleaning roller 120 is rotatably supported by a supporting lever 162 where the applying roller 112 is rotatably provided. By contacting the cleaning roller 120 with the outer peripheral surface of the fixing roller 102, the cleaning roller 120 is driven and rotated in accordance with the rotation of the fixing roller 102.

As shown in FIG. 3, the first temperature sensor 132 is a noncontact temperature sensor. An infrared film of the first temperature sensor 132 receives heat radiation from the fixing roller 102, and a rise in temperature of the infrared film is detected by a thermistor, so that the temperature of the fixing roller 102 is detected.

The pressure roller 104 is disposed below the fixing roller 102 at the transport path of the recording paper P. In an example of the pressure roller 104, an outer periphery of an aluminum cylindrical core bar 104B is covered by silicone rubber 104A, and a surface layer having separability allowing recording paper to separate therefrom (not shown) formed of fluorocarbon resin is formed along an outer peripheral surface of the silicone rubber 104A. A halogen heater 116 is provided inwardly from the core bar 104B. The halogen heater 116 serves as a heat source that is out of contact with an inner peripheral surface of the core bar 104B. The halogen heater 116 generates heat by application of current from a power supply (not shown), and heats the core bar 104B, so that the entire pressure roller 104 is heated.

At a side close to the opening 106A, a third temperature sensor 128 that detects the temperature of the pressure roller 104 is provided so as to oppose the outer peripheral surface of the pressure roller 104, and so as to be out of contact with the pressure roller 104. The third temperature sensor 128 has the same structure as the first temperature sensor 132. Here, the first temperature sensor 132, the second temperature sensor 126, and the third temperature sensor 128 are connected to the controller 20 (see FIG. 1). On the basis of input signals from the first temperature sensor 132, the second temperature sensor 126, and the third temperature sensor 128, the controller 20 performs output operations to the halogen heaters 114, 118, and 116.

Further, bearings (not shown) are provided at corresponding end portions of the pressure roller 104. The bearings are mounted to a central portion of a V-shaped bracket 124. The bracket 124 is provided so as to be rotatable in the direction of arrow +R or the direction of arrow −R around a shaft section 122, mounted to the housing 106, by an operation of an eccentric cam (not shown). By this, when the bracket 124 moves in the direction of arrow +R, the pressure roller 104 contacts the fixing roller 102, to form a contact portion N (nip), whereas, when the bracket 124 moves in the direction of arrow −R, the pressure roller 104 separates from the fixing roller 102.

Next, the applying unit 110 will be described.

As shown in FIG. 3, an example of the applying unit 110 includes the applying roller 112, a driving section 113, and a retracting mechanical section 160. The applying roller 112 contacts the outer peripheral surface 102 of the fixing roller 102 to apply the applying material 112B (see FIG. 5B) thereto. The driving section 113 includes a motor and a gear (not shown) that rotationally drives the applying roller 112. The retracting mechanical section 160 moves the applying roller 112 to the outer peripheral surface of the fixing roller 102.

In a structure in which the applying roller 112 is not required to retract from the fixing roller 102, the applying unit 110 does not require the retracting mechanical section 160. In a structure in which the applying roller 112 is driven and rotated with respect to the fixing roller 102, it is not necessary to provide the driving section 113. In an exemplary structure in the applying roller 112 is driven and rotated, the applying roller 112 is rotatably supported and is brought into contact with the fixing roller 112 to apply a load to an end portion of a rotary shaft of the applying roller 112. This causes a difference to occur between the peripheral velocity of the fixing roller 102 and the peripheral velocity of the applying roller 112.

Figure 5B:
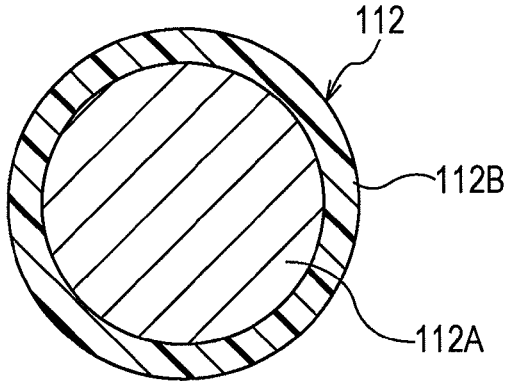
FIG. 5B is a sectional view of an applying roller according to the first exemplary embodiment of the present invention.
Figure 5C:
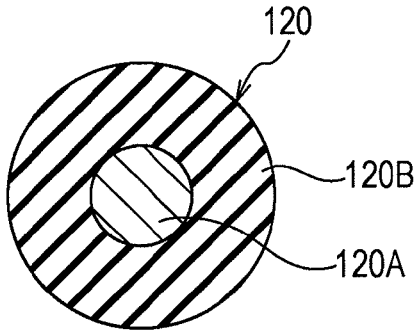
FIG. 5C is a sectional view of a cleaning roller according to the first exemplary embodiment of the present invention.
Figure 6A:
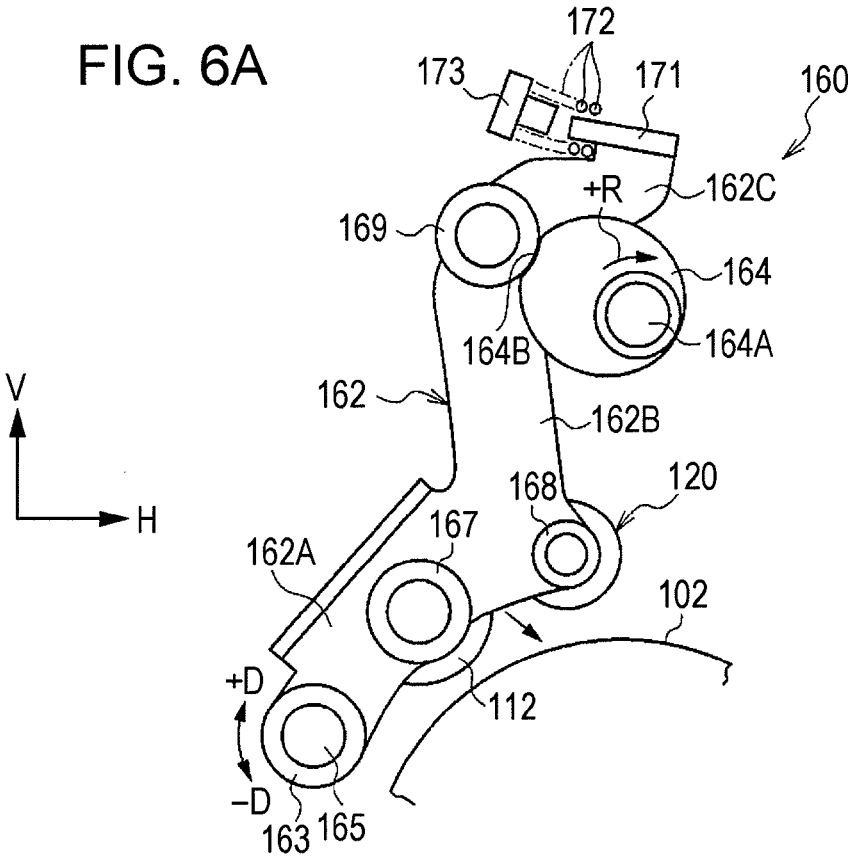
FIG. 6A illustrates a state of retraction of the applying roller according to the first exemplary embodiment of the present invention.

As shown in FIG. 5B, the applying roller 112 includes the applying material 112B held at an outer peripheral surface of a columnar core bar 112A formed of stainless steel (SUS). As a principal component, the applying material 112B contains cross-linked polytetrafluoroethylene (PTFE) serving as an example of fluorocarbon resin material. An example of applying material 112B is a material containing cross-linked polytetrafluoroethylene by 90 wt % or more and having a thickness of 100 μm.

In an exemplary method of producing the applying roller 112, resin powder containing polytetrafluoroethylene is electrostatically coated (that is, is coated while applying voltage) on the outer peripheral surface of the core bar 112A to which an adhesive layer (primer layer) is applied. Then, the core bar 112A on which the resin powder is coated is heated to a temperature that is higher than the crystalline melting point of the resin powder. In an environment without oxygen, polytetrafluoroethylene that is not cross-linked is irradiated with ionizing radiation (such as γ rays, electron rays, X rays, neutron rays, or high-energy ions) whose quantity of radiation is in the range of from at least 1 KGy to 10 MGy at most. This causes cross-linking to be performed to obtain cross-linked polytetrafluoroethylene that covers the outer peripheral surface of the core bar 112A.

Figure 8A:
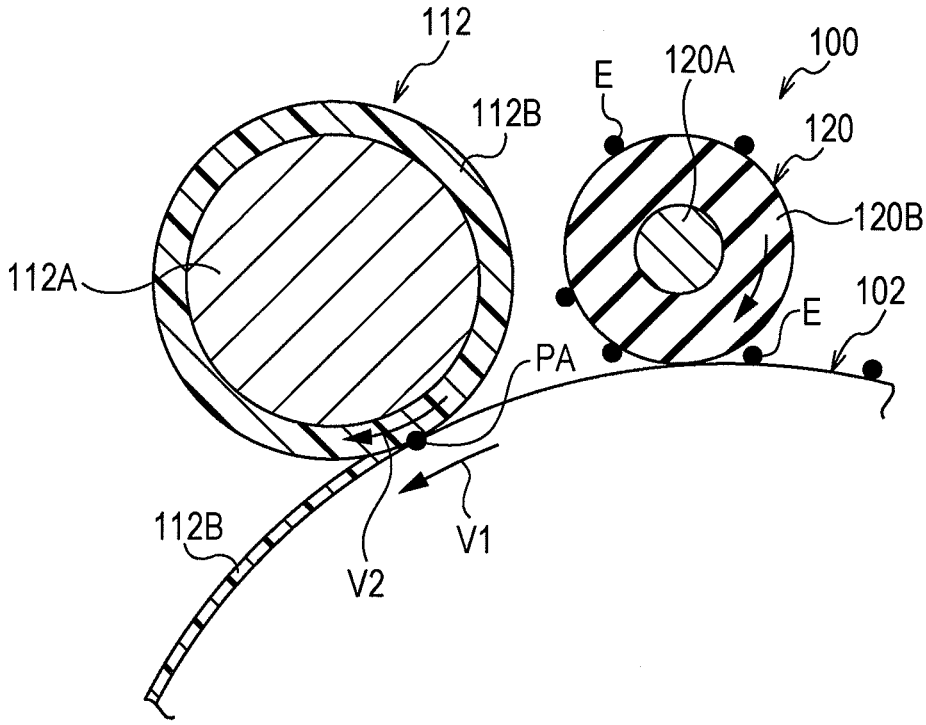
FIG. 8A is a schematic view of a state in which cleaning is performed by the cleaning roller according to the first exemplary embodiment of the present invention, and a state in which an applying material is applied by the applying roller.

As shown in FIG. 3, the driving section 113 is formed so that, in a state in which an outer peripheral surface of the applying roller 112 contacts the outer peripheral surface of the fixing roller 102, the driving section 113 causes the applying roller 112 (core bar 112A) to be rotationally driven independently of the fixing roller 102. Here, in an example of the driving of the applying roller 112 by the driving section 113, as shown in FIG. 8A, when the peripheral velocity of the fixing roller 102 is V1 and the peripheral velocity of the applying roller 112 is V2, the driving section 113 is set for rotationally driving the applying roller 112 so that the peripheral velocity V2 is a few percent higher than the peripheral velocity V1. That is, the driving section 113 causes the applying material 112B to be applied to the outer peripheral surface of the rotating fixing roller 102 while a peripheral velocity difference is caused to exist between the peripheral velocities.

As shown in FIG. 6A, the retracting mechanical section 160 includes a pair of the supporting levers 162 and a cam 164. The pair of supporting levers 162 support the applying roller 112 and the cleaning roller 120. The cam 164 reciprocates the supporting levers 162 in the direction of arrow +D (that is, the direction in which the applying roller 112 and the cleaning roller 120 come into contact with the outer peripheral surface of the fixing roller 102) or in the direction of arrow −D (that is, the direction in which the applying roller 112 and the cleaning roller 120 retract from the outer peripheral surface of the fixing roller 102). Since the supporting lever 162 at the near side and the supporting lever 162 at the far side have the same structure, the supporting lever 162 at the far side will not be illustrated and described.

Each supporting lever 162 is formed of a steel plate, and includes a first lever section 162A, a second lever section 162B, and a third lever section 162C, which form an integrated structure. The first lever section 162A extends obliquely in an upper right direction in FIGS. 6A and 6B. The second lever section 162B extends in the direction of arrow V after being bent at an upper end of the first lever section 162A. The third lever section 162C extends in the direction of arrow H after being bent at an upper beam of the second lever section 162B.

A bearing 163 is mounted to an illustrated lower end of the first lever section 162A. A rotary shaft 165 secured to the housing 106 (see FIG. 3) through a bracket (not shown) is inserted into the bear 163. The rotary shaft 165 is disposed so that its axial direction is the same as an axial direction of the fixing roller 102. This allows each supporting lever 162 to reciprocate in the direction of arrow +D or the direction of arrow −D in FIGS. 6A and 6B.

A bracket (not shown) is provided at the center of the first lever section 162A so as to be slidable towards the fixing roller 102. A bearing 167 is mounted to the bracket. The bearing 167 rotatably supports both ends of the applying roller 112. Here, a spring (not shown) biases the bracket towards the fixing roller 102. Even if the diameter of the applying roller 112 becomes smaller than its diameter in an initial state as the applying material 112B is consumed, the applying roller 112 contacts the outer peripheral surface of the fixing roller 102. The driving section 113 is formed so that, even if the applying roller 112 is moved, driving force is transmitted from the driving section 113 to the applying roller 112.

A bearing 168 is mounted to the bent portion between the first lever section 162A and the second lever section 162B. The bearing 168 rotatably supports both end portions of the cleaning roller 120. A follower 169 forming a portion of each supporting lever 162 is rotatably mounted to the bent portion between the second lever section 162B and the third lever section 162C.

An upper end portion of the third lever section 162C is provided with a catching section 171 formed by cutting and bending a portion of the third lever section 1620. A securing section 173 for securing an end of a spring 172 is provided in the housing 106 (see FIG. 3) in a direction of movement of the catching section 171 when each supporting lever 162 is moved in the direction of arrow −D. Here, when one end of the spring 172 is secured to the securing section 173 and the other end of the spring 172 is caught by the catching section 171, each supporting lever 162 is biased in the direction of arrow +D.

A pressing force that causes the applying roller 112 to press the fixing roller 102 when the spring 172 biases each supporting lever 162 is set, for example, at approximately ⅓ of a pressing force that causes the external heating roller 108 to press the fixing roller 102 when the springs 152 of the retracting mechanical section 140 shown in FIG. 4 bias the flange 148.

As shown in FIG. 6A, the cam 164 is an elliptical eccentric cam provided so as to be rotatable around a rotary shaft 164A. A portion of an outer periphery of the eccentric cam having the largest eccentricity has a recessed portion 164B having a curvature that matches the curvature of the follower 169. The cam 164 is rotated in the direction of arrow +R by driving force of a motor (not shown). When an end of each supporting lever 162 is biased by the spring 172, the cam 164 rotates while contacting the follower 169.

Here, by rotating the cam 164 in the direction of arrow +R, each supporting lever 162 reciprocates in the direction of arrow +D or in the direction of arrow −D around the rotary shaft 165. As shown in FIG. 6A, when the cam 164 is positioned where an outer periphery of the recessed portion 164B and an outer periphery of the follower 169 contact each other, the applying roller 112 and the cleaning roller 120 are disposed at a retraction position where they are retracted from the outer peripheral surface of the fixing roller 102 (hereunder referred to as a retracting operation of the retracting mechanical section 160).

Figure 6B:
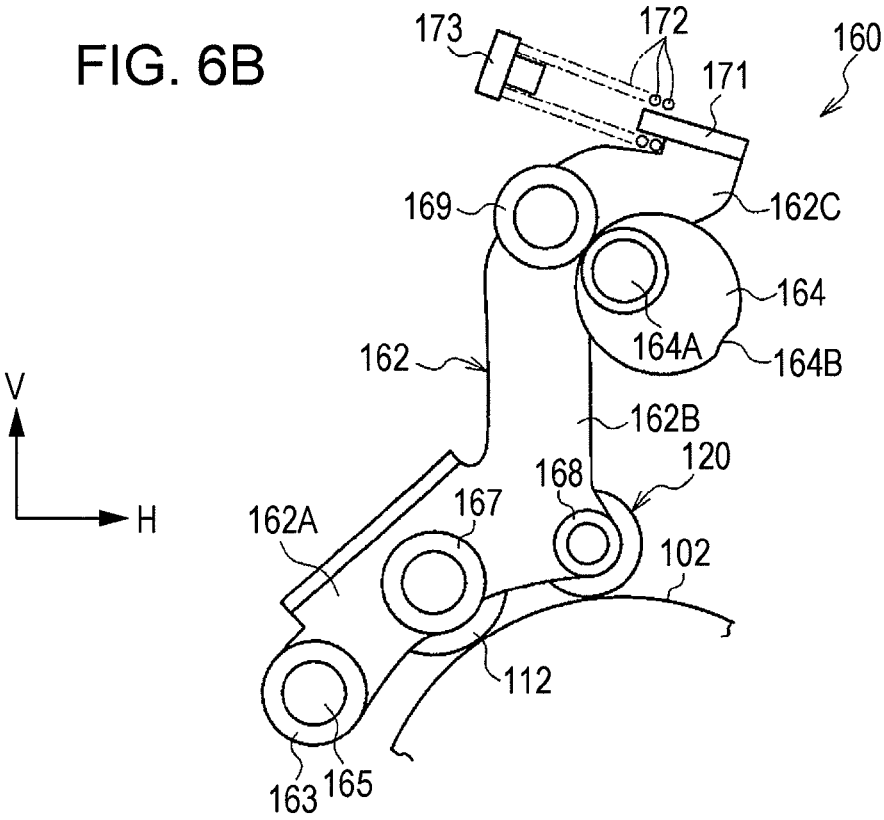
FIG. 6B illustrates a state in which the applying roller according to the first exemplary embodiment of the present invention contacts an outer peripheral surface of the fixing roller.

In contrast, as shown in FIG. 6B, when a portion of the cam 164 disposed opposite the recessed portion 164B contacts the follower 169, the applying roller 112 and the cleaning roller 120 are disposed at a contact position where they contact the outer peripheral surface of the fixing roller 102 (hereunder referred to as a contacting operation of the retracting mechanical section 160). A plate-like member (not shown) contacts an outer peripheral surface of the cleaning roller 120, and removes and collects extraneous matter adhered to the outer peripheral surface of the cleaning roller 120.

As shown in FIG. 7, in an example of the applying roller 112, in an axial direction thereof, its width extends, not only beyond the range of the width W1 occupied by a piece of A4-size recording paper P (not shown) that is vertically transported, but also beyond the range of the width W2 occupied by a piece of A3-size recording paper P (not shown) that is vertically transported (that is, a piece of A4-size recording paper that is horizontally transported). Therefore, the applying material 112B is applied to a range including the range of the width W2 of the outer peripheral surface of the fixing roller 102.

Next, the operation according to the first exemplary embodiment will be described.

In the fixing device 100 shown in FIG. 3, when a fixing operation for fixing toner T to recording paper P is performed, a contacting operation of the retracting mechanical section 140 (see FIG. 4) causes the external heating roller 108 to contact the outer peripheral surface of the fixing roller 102, and a retracting operation of the retracting mechanical section 160 (see FIG. 6A) causes the cleaning roller 120 and the applying roller 112 to retract from the outer peripheral surface of the fixing roller 102. Here, thermal energy is supplied from the external heating roller 108 to the fixing roller 102, whose thermal energy has been reduced by the fixing of the toner T. Therefore, a temperature reduction of the fixing roller 102 is suppressed, so that the fixing operation is continued.

In contrast, when a fixing operation is not performed by the fixing device 100 (for example, when the fixing device 100 is in a standby state after the fixing operation has ended), a retracting operation of the retracting mechanical section 140 (see FIG. 4) causes the external heating roller 108 to retract from the outer peripheral surface of the fixing roller 102, and a contacting operation of the retracting mechanical section 160 (see FIG. 6A) causes the cleaning roller 120 and the applying roller 112 to contact the outer peripheral surface of the fixing roller 102.

Next, as shown in FIG. 8A, when, in the fixing device 100, the rotation of the fixing roller 102 is continued at the peripheral velocity V1, hard extraneous matter E (such as paper powder, small lumps of toner T, and dust) enters a portion where the fixing roller 102 and the cleaning roller 120 contact each other. At this time, since the elastic member 120B of the cleaning roller 120 is elastically deformed in accordance with an external shape of the extraneous matter E, the degree by which the outer peripheral surface of the fixing roller 102 is made rough by the extraneous matter E is suppressed.

By elastic force that causes the elastic member 120B, provided at the outer peripheral surface of the cleaning roller 120, to be restored to its original shape, the cleaning roller 120 scrapes off the extraneous matter E from the outer peripheral surface of the fixing roller 102. This causes the hard extraneous matter E to be removed even if the hard extraneous matter E adheres to the outer peripheral surface of the fixing roller 102. Since the cleaning roller 120 is rotated and driven with respect to the rotation of the fixing roller 102, application of excess load to the rotation of the fixing roller 102 is suppressed.

The elastic member 120B of the cleaning roller 120 is formed of silicone rubber. The outer peripheral surface of the cleaning roller 120 is not provided with a surface layer having separability allowing recording paper to separate therefrom formed of fluorocarbon resin. Attraction force between the extraneous matter E and the cleaning roller 120 that does not include a surface layer having separability allowing recording paper to separate therefrom is greater than attraction force between the extraneous matter E and the fixing roller 102 including the surface layer having separability allowing recording paper to separate therefrom 102C (see FIG. 5A) at the outer peripheral surface thereof. Therefore, the extraneous matter E that enters the portion where the fixing roller 102 and the cleaning roller 120 contact each other adheres to and is collected by the outer peripheral surface (the elastic member 120B) of the cleaning roller 120. Since the extraneous matter E is collected by the cleaning roller 120, movement of the extraneous matter E to the application position PA of the applying material 112B is suppressed, so that the degree by which the outer peripheral surface of the fixing roller 102 is made rough is suppressed.

Figure 8B:
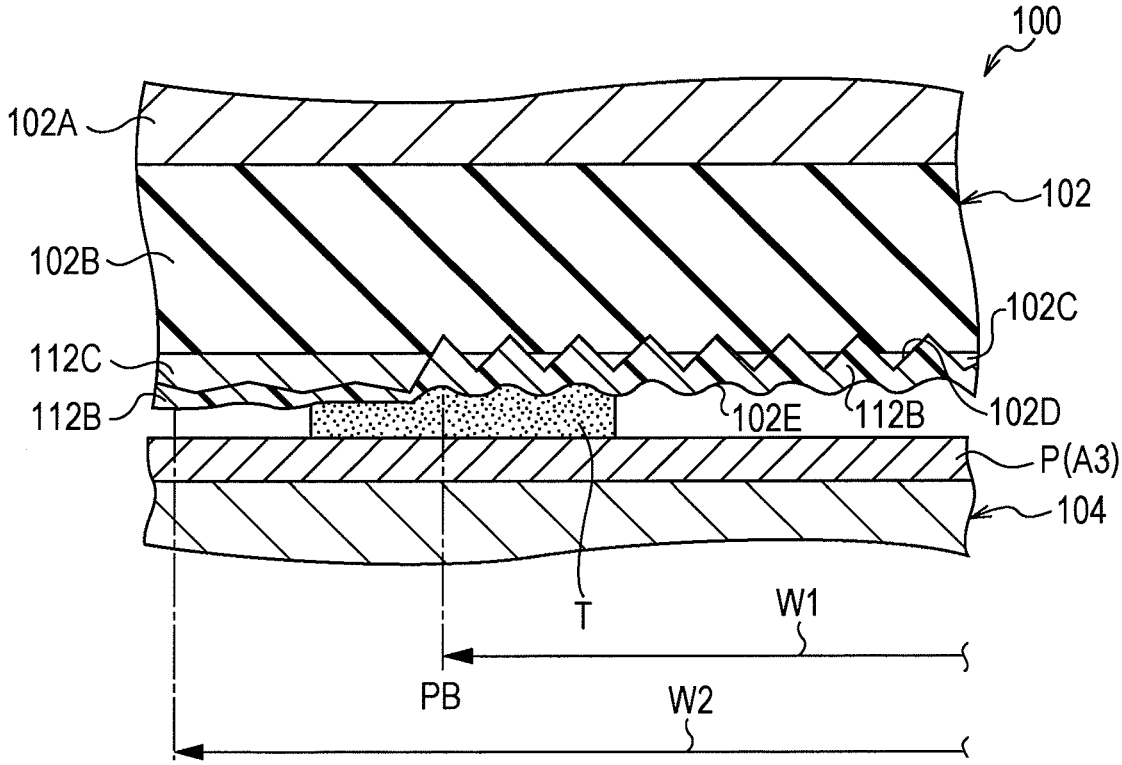
FIG. 8B is a schematic view of a state in which toner is fixed to the recording paper by the fixing roller according to the first exemplary embodiment of the present invention.

Here, in the image forming apparatus 10 shown in FIG. 1, after a standby time has passed subsequent to performing image formation operations and fixing operations on many pieces of A4-size recording paper P, when an image forming operation is performed on a piece of A3-size recording paper P, as shown in FIG. 8B, the range of the outer peripheral surface of the fixing roller 102 within the width W1 (corresponding to a width occupied by a piece of A4-size recording paper P that is transported vertically) corresponds to a rough surface 102D whose surface roughness is greater than that of the surface of the original surface layer having separability allowing recording paper to separate therefrom 102C. This rough surface 102D results from, for example, scraping of the fixing roller 102 by wearing of the surface layer having separability allowing recording paper to separate therefrom 102C. When fixing is performed on the piece of A3-size recording paper P under this condition, the surface roughnesses of the left and right sides of an end-portion position PB in the range of the width W1 differ from each other. Therefore, in correspondence with the end-portion position PB, streaks are produced (image unevenness occurs) in toner images after the fixing.

However, in the fixing device 100 according to the exemplary embodiment, as shown in FIG. 8A, the applying roller 112 that contacts the outer peripheral surface of the fixing roller 102 is driven by the driving section 113 (see FIG. 3), and rotates at the peripheral velocity V2. Since, at the application position PA, a peripheral velocity difference (V2−V1) occurs between the peripheral velocity V2 of the applying roller 112 and the peripheral velocity V1 of the fixing roller 102, the applying material 112B at the outer periphery of the applying roller 112 is transferred to the outer peripheral surface of the fixing roller 102 by friction force, the applying material 112B is held by (a layer of the applying material 112B is formed at) the outer peripheral surface of the fixing roller 102 after passing the application position PA.

Therefore, as shown in FIG. 8B, the outer peripheral surface of the fixing roller 102 covered by the applying material 112B becomes a smooth surface 102E having a roughness that is less than the roughness of the rough surface 102D. Therefore, compared to a structure in which the applying material 112B is not applied to the outer peripheral surface of the fixing roller 102, the roughness of the outer peripheral surface of the fixing roller 102 is reduced. Since the applying material 112B is formed of cross-linked polytetrafluoroethylene (PTFE), which is a fluorocarbon resin material, its separability with respect to the toner T is higher than that of silicone rubber. Therefore, the applying material 112B applied to the outer peripheral surface of the fixing roller 102 functions as another surface layer having separability allowing recording paper to separate therefrom, so that the surface layer having separability allowing recording paper to separate therefrom 102C of the fixing roller 102 is reinforced.

Further, in the fixing device 100, the toner T existing on a piece of A3-size recording paper P in the range of the width W2 is fused by being heated and pressed at the smooth surface 102E. Therefore, the surface during the hardening of the toner T is smoother than the rough surface 102D. Consequently, a reduction in image quality caused by the outer peripheral surface of the fixing roller 102 that is rough is suppressed.

In addition, in the fixing device 100, the applying material 112B contains cross-linked polytetrafluoroethylene of high molecular weight. Therefore, attraction force with respect to PFA of the surface layer having separability allowing recording paper to separate therefrom 102C of the fixing roller 102 is greater for the applying material 112B according to the exemplary embodiment containing cross-linked polytetrafluoroethylene than for a structure containing polytetrafluoroethylene that is not cross-linked. Consequently, when the applying material 112B is applied to the outer peripheral surface of the fixing roller 102 using the applying roller 112, the applying material 112B adheres to the outer peripheral surface of the fixing roller 102, so that it is not easily separated therefrom.

Here, a surface roughness Ra of a fixing roller 102 (to which the applying material 112B is not applied) according to a comparative example is measured at a portion where streaks are formed. The fixing roller 102 causes streaks to be formed in fixed toner images in accordance with the end-portion position PB. This measurement is performed using an ultradeep shape measurement microscope (product of Keyence Corporation: VK8510). The surface roughness Ra is from 0.17 μm to 0.33 μm, with an average value being approximately 0.23 μm.

A surface roughness Ra of the fixing roller 102 to which the applying material 112B is applied according to the exemplary embodiment is measured at the end-portion position PB using the same ultradeep shape measurement microscope (product of Keyence Corporation: VK8510). The surface roughness Ra is from 0.10 μm to 0.19 μm, with an average value being approximately 0.16 μm. This shows that the roughness of the outer peripheral surface of the fixing roller 102 (to which the applying material 112B is applied) according the exemplary embodiment is less than the roughness of an outer peripheral surface of the fixing roller 102 according to the comparative example.

Next, an exemplary applying device, an exemplary fixing device, and an exemplary image forming apparatus according to a second exemplary embodiment of the present invention will be described. Components according to the second exemplary embodiment that are basically the same as those according to the first exemplary embodiment will be given the same reference numerals as those in the first exemplary embodiment, and will not be described below.

Figure 9:
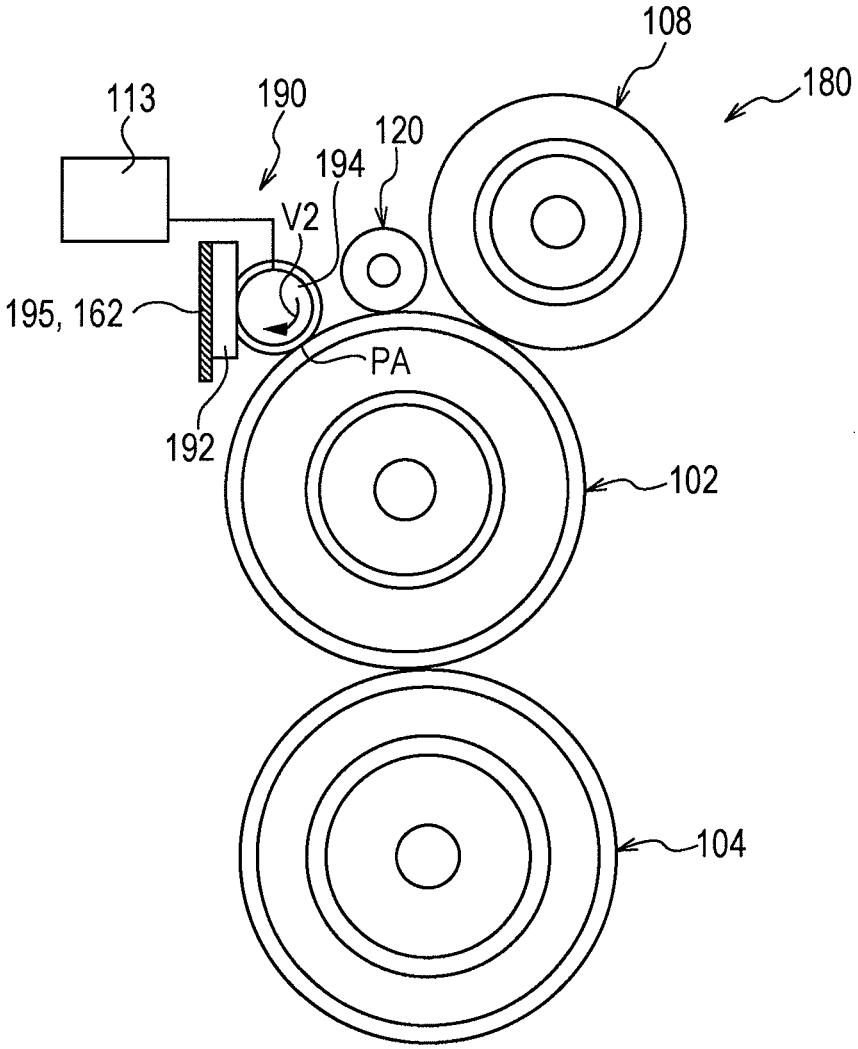
FIG. 9 illustrates a structure of a fixing device according to a second exemplary embodiment of the present invention.

FIG. 9 illustrates a fixing device 180 according to the second exemplary embodiment. The fixing device 180 includes an applying unit 190 serving as an exemplary applying device instead of the applying unit 110 in the fixing device 100 (see FIG. 3) according to the first exemplary embodiment. The other structural features are the same as those of the first exemplary embodiment. FIG. 9 illustrates a fixing roller 102, a pressure roller 104, an external heating roller 108, a cleaning roller 120, and the applying unit 190, and does not illustrate the other components.

The applying unit 190 includes an applying material 192, a holding member 195, an applying roller 194, a driving section 113, and a retracting mechanical section 160 (see FIG. 6A). The applying material 192 is a plate-like material containing cross-linked polytetrafluoroethylene (serving as an example of a fluorocarbon resin material) by at least 90 wt % as a principal component. The holding member 195 serving as an exemplary holding unit holds the applying material 192. The applying roller 194 serving as an exemplary applying member applies the applying material 192 received from the holding member 195 to the fixing roller 102. The driving section 113 rotationally drives the applying roller 194. The retracting mechanical section 160 moves the applying roller 194 to an outer peripheral surface of the fixing roller 102.

The applying roller 194 is a columnar roller formed of stainless steel (SUS). Its axial length is the same as that of the applying roller 112 (see FIG. 7) according to the first exemplary embodiment. The longitudinal width of the applying material 192 is equivalent to the axial length of the applying roller 194. When an outer peripheral surface of the applying roller 194 is in contact with the outer peripheral surface of the fixing roller 102, the driving section 113 independently rotationally drives the applying roller 194 with respect to the fixing roller 102 with the peripheral velocity V2.

In a structure in which the applying roller 194 need not be retracted from the fixing roller 102, the applying unit 190 need not be provided with the retracting mechanical section 160. In a structure in which the applying roller 194 is to be driven and rotated with respect to the fixing roller 102, the driving section 113 need not be provided.

The holding member 195 includes holding portions (not shown) at corresponding end portions thereof in a longitudinal direction of the holding member 195 for holding corresponding end portions of the applying material 192. The holding member 195 is replaceably mounted to each supporting lever 162 (see FIG. 6A) of the retracting mechanical section 160. An exemplary replaceable structure is a structure in which an end portion of the holding member 195 is fitted to a hole formed in each supporting lever 162.

Here, in the applying unit 190, when the holding member 195 is mounted to each supporting lever 162 in the housing 106 (see FIG. 3), the applying material 192 is pushed against the outer peripheral surface of the applying roller 194 by biasing force of a spring (not shown). That is, the applying roller 194 and the applying material 192 (and the cleaning roller 120) move together in accordance with the movement of each supporting lever 162. At the holding member 195, the applying material 192 is replaceable by retracting the spring.

Next, an operation according to the second exemplary embodiment will be described.

In the fixing device 180 shown in FIG. 9, when a fixing operation is performed, a contacting operation of the retracting mechanical section 140 (see FIG. 4) causes the external heating roller 108 to contact the outer peripheral surface of the fixing roller 102. A retracting operation of the retracting mechanical section 160 (see FIG. 6A) causes the cleaning roller 120, the applying material 192, and the applying roller 194 to retract from the outer peripheral surface of the fixing roller 102.

In contrast, when a fixing-operation is not performed by the fixing device 180 (for example, when the fixing device 180 is in a standby state after the fixing operation has ended), a retracting operation of the retracting mechanical section 140 (see FIG. 4) causes the external heating roller 108 to retract from the outer peripheral surface of the fixing roller 102, and a contacting operation of the retracting mechanical section 160 (see FIG. 6A) causes the cleaning roller 120 and the applying roller 194 to contact the outer peripheral surface of the fixing roller 102.

Figure 10A:
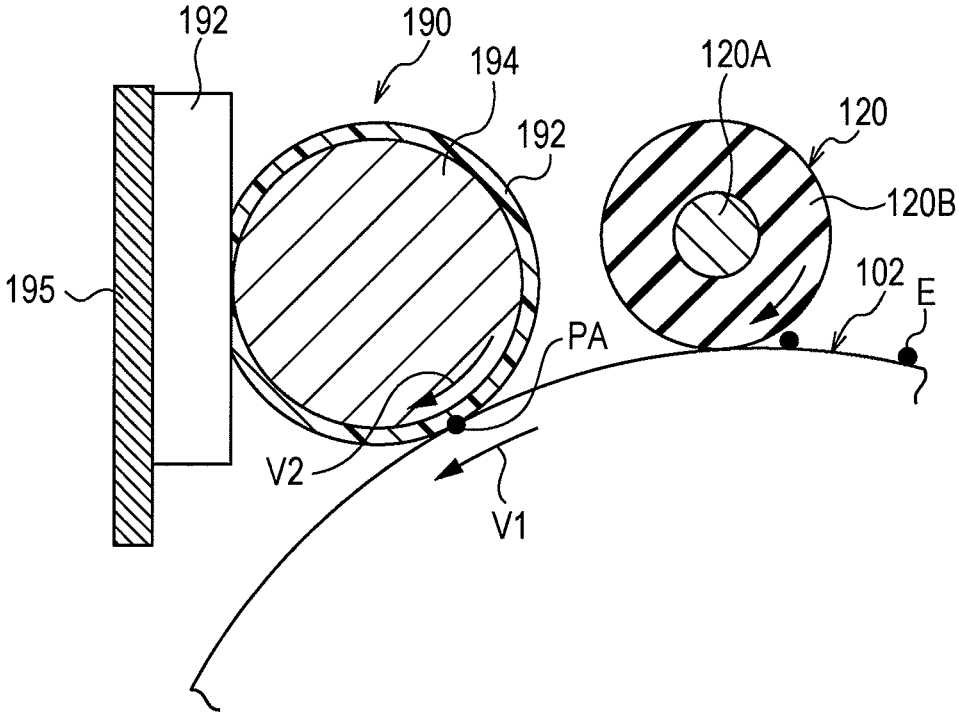
FIGS. 10A and 10B are schematic views of a state in which cleaning is performed by a cleaning roller according to the second exemplary embodiment of the present invention, and a state in which an applying material is applied by an applying roller.

Subsequently, as shown in FIG. 10A, in the fixing device 180, in a standby state, the fixing roller 102 rotates at the peripheral velocity V1, and the cleaning roller 120 is driven and rotated in accordance with the rotation of the fixing roller 102. The driving section 113 (see FIG. 9) rotates the applying roller 194 with the peripheral velocity V2. The applying roller 194 that is in contact with the applying material 192 held by the holding member 195 rotates and slides, so that the applying material 192 is transferred to and held by the outer peripheral surface of the applying roller 194.

Figure 10B:
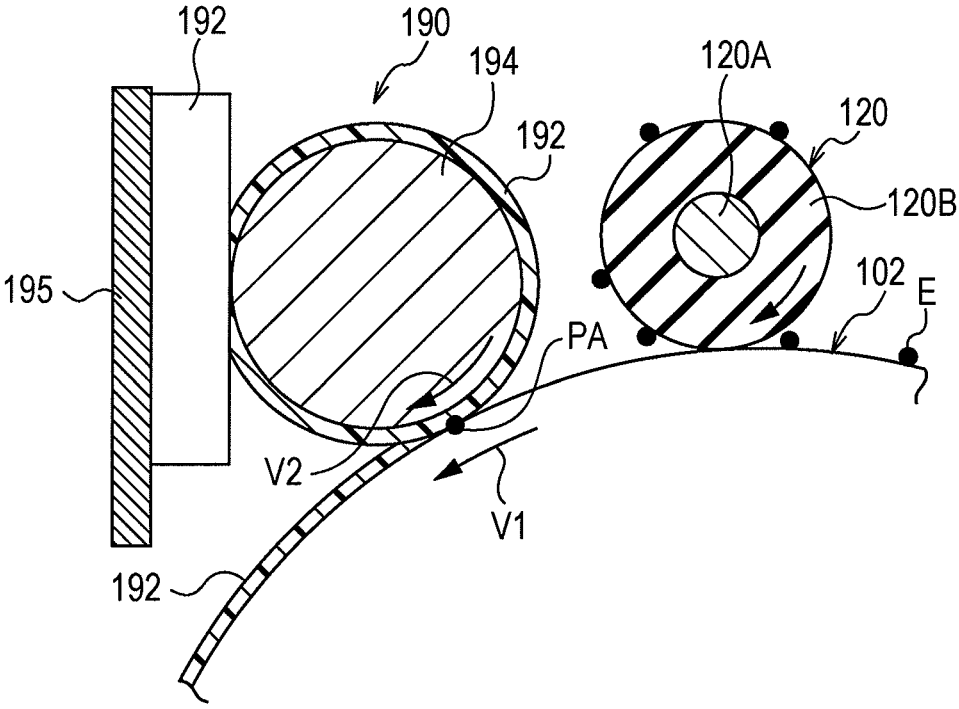

Next, as shown in FIG. 10B, when the rotation of the fixing roller 102 is continued at the peripheral velocity V1, hard extraneous matter E adhered to the outer peripheral surface of the fixing roller 102 is collected (removed) by the cleaning roller 120. Since the extraneous matter E is collected by the cleaning roller 120, movement of the extraneous matter E to an application position PA where the applying material 192 is applied is suppressed, so that the degree by which the outer peripheral surface of the fixing roller 102 is made rough is suppressed.

Since, at the application position PA, a peripheral velocity difference (V2−V1) occurs between the peripheral velocity of the applying roller 194 and the peripheral velocity of the fixing roller 102, the applying material 192 at the outer periphery of the applying roller 194 is transferred to the outer peripheral surface of the fixing roller 102 by friction force. In addition, the applying material 192 is held by the outer peripheral surface of the fixing roller 102 after passing the application position PA. Therefore, as shown in FIG. 8B, the outer peripheral surface of the fixing roller 102 covered by the applying material 192 becomes a smooth surface 102E (see FIG. 8B). Therefore, compared to a structure in which the applying material 192 is not applied to the outer peripheral surface of the fixing roller 102, the roughness of the outer peripheral surface of the fixing roller 102 is reduced.

Further, in the fixing device 180, toner T existing on a piece of recording paper P is fused by being heated and pressed at the smooth surface 102E. Therefore, the surface during the hardening of the toner T becomes smooth. Consequently, a reduction in image quality caused by the roughness of the outer peripheral surface of the fixing roller 102 is suppressed.

In addition, in the fixing device 180, the applying material 192 contains cross-linked polytetrafluoroethylene of high molecular weight. Therefore, attraction force with respect to PFA of the surface layer having separability allowing recording paper to separate therefrom 102C (see FIG. 5A) of the fixing roller 102 is greater for the applying material 192 according to the exemplary embodiment containing cross-linked polytetrafluoroethylene than for a structure containing polytetrafluoroethylene that is not cross-linked. Consequently, when the applying material 192 is applied to the outer peripheral surface of the fixing roller 102 using the applying roller 194, the applying material 192 adheres to the outer peripheral surface of the fixing roller 102, so that it is not easily separated therefrom.

In addition, in the fixing device 180, the applying material 192 is independently provided of the applying roller 194. When the applying material 192 is replaced, the applying roller 194 need not be replaced. Therefore, compared to a structure in which the applying material 192 directly contacts the fixing roller 102, the applying material 192 is easily replaced. Further, since it is not necessary to perform cross-linking after resin powder prior to cross-linking is electrostatically applied to the roller, the applying unit 190 is easily manufactured.

The present invention is not limited to the above-described exemplary embodiments.

Figure 11A:
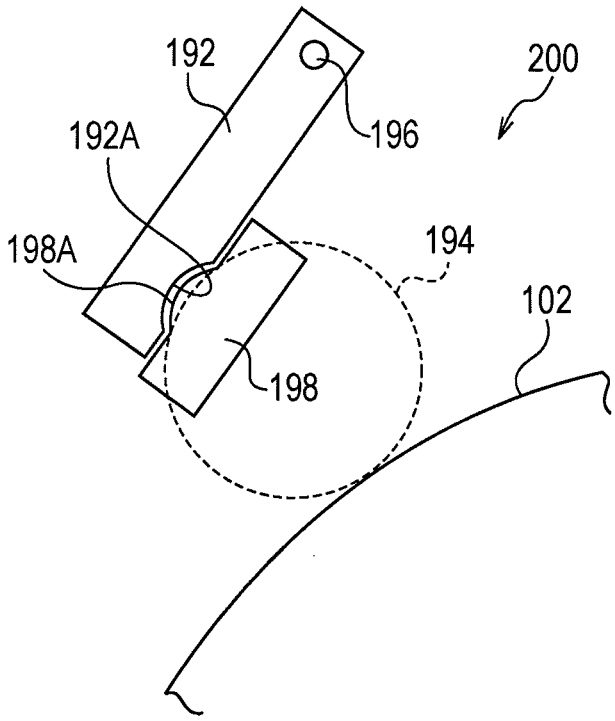
FIGS. 11A and 11B are schematic views of a mechanism that causes a plate-like applying material to retract from an outer peripheral surface of the applying roller when the applying roller retracts in a first modification according to the present invention.

As shown in FIG. 11A, in a first modification, a shaft 196 is provided at one end of the applying material 192 according to the second exemplary embodiment, and both end portions of the shaft 196 are supported by the housing 106 (see FIG. 3). Recessed portions 192A are formed in surfaces at corresponding ends of the applying material 192 facing the applying roller 194. At one end side of the applying roller 194, a protrusion 198 is secured to the supporting levers 162 (see FIG. 6A). The protrusion 198 has a protruding portion 198A having a size that allows it to be inserted into the recessed portions 192A. An applying unit 200 may be formed in this way.

Figure 11B:
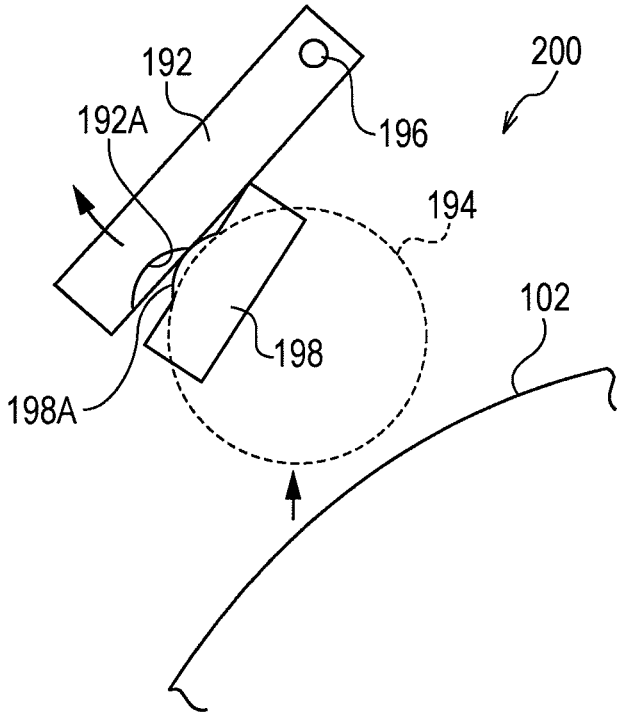

As shown in FIG. 11B, in the applying unit 200, when each supporting lever 162 (see FIG. 6A) moves and the applying roller 194 is separated from the outer peripheral surface of the fixing roller 102, the protruding portion 198A of the protrusion 198 pushes upward a peripheral edge portion of each recessed portion 192A of the applying material 192. By this, in the retraction state of the applying roller 194, the applying material 192 and the applying roller 194 no longer contact each other, so that continuous application of a load on the applying roller 194 and the applying material 912 is suppressed. As shown in FIG. 11A, in the state of contact of the applying roller 194 and the fixing roller 102, the protruding portion 198A enters the recessed portions 192A, so that the applying material 192 and the applying roller 194 contact each other.

Figure 12A:
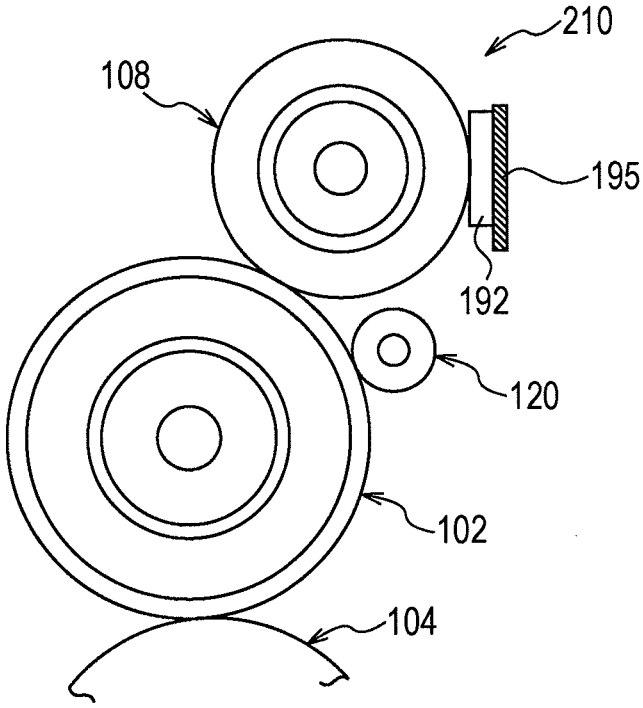
FIG. 12A is a schematic view of a structure in which an external heating roller serves as an applying member for applying an applying material in a second modification according to the present invention.

In a second modification, as shown in FIG. 12A, it is possible to use a fixing device 210 in which the cleaning roller 120 is disposed upstream from the external heating roller 108 in the direction of rotation of the fixing roller 102, and the applying material 192 is caused to contact the outer peripheral surface of the external heating roller 108, so that the external heating roller 108 is also used as an applying member of the applying material 192. This reduces the number of parts of the fixing device.

Figure 12B:
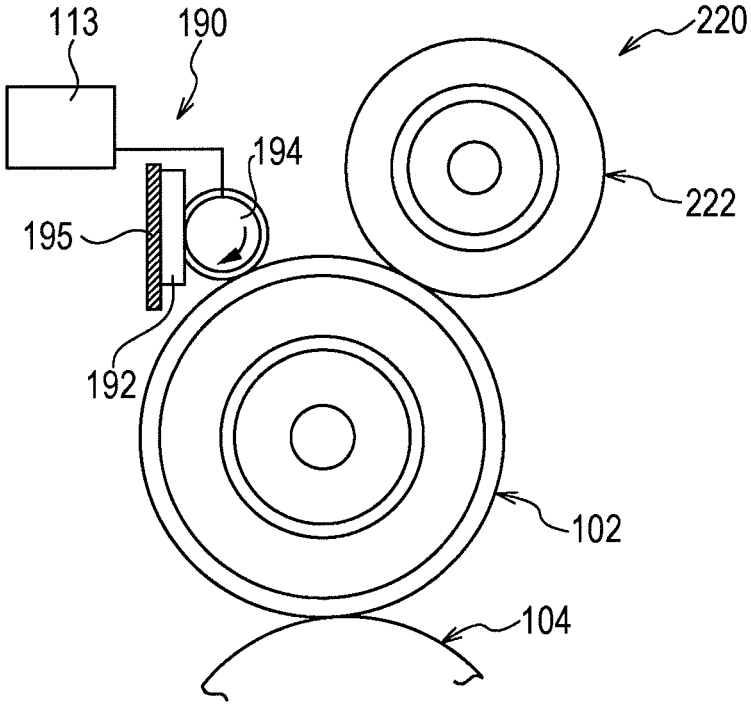
FIG. 12B is a schematic view of a structure in which the external heating roller serves as a cleaning roller in a third modification according to the present invention.

In a third modification, as shown in FIG. 12B, it is possible to use a fixing device 220 including an external heating roller 222 that is also used as a rotary member of a cleaning unit instead of the external heating roller 108 (see FIG. 9) of the fixing device 180 according to the second exemplary embodiment. The structure of the external heating roller 222 corresponds to a structure in which a silicone rubber layer (not shown) is formed along the outer peripheral surface of the external heating roller 108. The external heating roller 222 collects extraneous matter from the outer peripheral surface of the fixing roller 102. The thickness of the silicone rubber layer is set within a range that allows the external heating roller 222 to heat the outer peripheral surface of the fixing roller 102. The amount of extraneous matter remaining on an outer peripheral surface of the external heating roller 222 may be suppressed by contacting a cleaning blade (not shown) with the external heating roller 222.

In addition, instead of using the fixing roller 102, fixing belt that is heated by electromagnetic induction may be used. The types of recording paper P are not limited to A4-size recording paper or A3-size recording paper. They may include recording paper P of other sizes. The applying material 192 is not limited to a plate material. It may be a sheet material, a block material, or a chip material. The application of the applying material is not limited to application by a roller member. The applying material may be applied to the outer peripheral surface of the fixing roller 102 using an endless belt member. Alternatively, the applying material may be applied by directly pressing a plate member against the fixing roller 102.

Other examples of fluorocarbon resin materials that may be used are tetrafluoroethylene-perfluoroalkylvinylether copolymer (PFA, tetrafluoroethylene-hexafluoropropylene copolymer (FEP), ethylene tetrafluoroethylene copolymer (ETFE), polyvinylidene difluoride (PVDF), and polychlorotrifluoroethylene.

Further, the applying roller 112 and the applying roller 194 are not limited to those that are independently driven by the driving section 113 as mentioned above. They may be driven and rotated with respect to the fixing roller 102 to form a layer of the applying material 112B (or the applying material 192). When the cleaning is performed using the external heating roller 108, the cleaning roller 120 need not be used. In addition, it is possible to cause the applying material 192 to contact the outer peripheral surface of the pressure roller 104, and use the pressure roller 104 as the applying member of the applying material 192.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An applying device comprising:

an applying member that applies an applying material to an outer peripheral surface of a fixing member that rotates, while a peripheral velocity difference is caused to exist between a peripheral velocity of the fixing member and a peripheral velocity of the applying member, the applying material having an outer peripheral surface containing a fluorocarbon resin material, wherein the applying material contains cross-linked polytetrafluoroethylene as the fluorocarbon resin material, wherein the outer peripheral surface of the applying member is configured to directly contact the fixing member, and wherein the applying member has a retracting mechanical section that brings the applying member in contact with the fixing member and separates the applying member from the fixing member.

2. The applying device according to claim 1, further comprising a holding unit that holds the applying material, wherein the applying member applies the applying material received from the holding unit to the fixing member.

3. A fixing device comprising:

the fixing member including a surface layer having separability allowing a recording medium to separate therefrom, the fixing member heating and fixing a developer image on the recording medium while the fixing member rotates;

a pressure member that applies pressure with the recording medium being interposed between the fixing member and the pressure member; and the applying device according to claim 1 that applies the applying material to the outer peripheral surface of the fixing member, wherein the fixing device has an external heating roller that is brought into contact the fixing member and separates from the fixing member, and wherein the applying member contacts the fixing member after the external heating roller separates from the fixing member.

4. A fixing device according to claim 3, further comprising a cleaning unit disposed upstream from an application position where the applying material is applied in a direction of rotation of the fixing member, the cleaning unit cleaning the outer peripheral surface of the fixing member, wherein the retracting mechanical section brings the cleaning unit in contact with the fixing member and separates from the fixing member.

5. A fixing device according to claim 4, wherein the cleaning unit is a rotary member including an elastic member at an outer peripheral surface side thereof.

6. An image forming apparatus comprising:

a developer image forming unit that forms the developer image;

a transfer unit that transfers the developer image formed at the developer image forming unit to the recording medium; and the fixing device according to claim 3 that fixes the developer image transferred at the transfer unit to the recording medium, the fixing device being capable of performing the fixing on a plurality of types of the recording media having different widths.

* * * * *